US011419783B2

(12) United States Patent
Giampietro et al.

(10) Patent No.: US 11,419,783 B2
(45) Date of Patent: Aug. 23, 2022

(54) DEVICE FOR SEXUAL STIMULATION HAVING A HOLLOW PISTON

(71) Applicants: Giuseppe Giampietro, Isla Margarita (VE); Ralf Zander, Berlin (DE)

(72) Inventors: Giuseppe Giampietro, Isla Margarita (VE); Ralf Zander, Berlin (DE)

( * ) Notice: Subject to any disclaimer, the term of this patent is extended or adjusted under 35 U.S.C. 154(b) by 518 days.

(21) Appl. No.: 14/773,177

(22) PCT Filed: Jan. 22, 2014

(86) PCT No.: PCT/EP2014/051257

§ 371 (c)(1),
(2) Date: Sep. 4, 2015

(87) PCT Pub. No.: WO2014/135301

PCT Pub. Date: Sep. 12, 2014

(65) Prior Publication Data

US 2016/0008214 A1 Jan. 14, 2016

(30) Foreign Application Priority Data

Mar. 7, 2013 (DE) ..... 10 2013 102 280.4

(51) Int. Cl.
*A61H 19/00* (2006.01)

(52) U.S. Cl.
CPC ..... *A61H 19/32* (2013.01); *A61H 2201/0111* (2013.01); *A61H 2201/0153* (2013.01);
(Continued)

(58) Field of Classification Search
CPC ..... A61H 19/00–50; A61H 7/00–008; A61H 9/00–0092; A61H 2201/149;
(Continued)

(56) References Cited

U.S. PATENT DOCUMENTS 4,431,062 A * 2/1984 Wanner ..... B25D 11/08 173/104
6,902,525 B1 * 6/2005 Jewell ..... A61H 19/44 600/38
(Continued)

FOREIGN PATENT DOCUMENTS

CN 2728475 Y 9/2005
DE 10252401 A1 5/2004
(Continued)

OTHER PUBLICATIONS

International Search Report issued by the European Patent Office International Searching Authority in international application No. PCT/EP2014/051257 dated Apr. 9, 2014.
(Continued)

*Primary Examiner* — Catherine B Kuhlman
(74) *Attorney, Agent, or Firm* — Meunier Carlin & Curfman LLC

(57) ABSTRACT

The invention relates to a device (1) for sexual stimulation having a hollow piston (3), a drive cylinder (5), and transmission means (7, 9) for converting a rotational movement of the drive cylinder into an axial movement of the hollow piston, wherein the drive cylinder (5) encloses the hollow piston (3) at least partially.

8 Claims, 3 Drawing Sheets

(52) U.S. Cl.
CPC ..... *A61H 2201/1215* (2013.01); *A61H 2201/149* (2013.01); *A61H 2201/1664* (2013.01); *A61H 2201/1669* (2013.01); *A61H 2201/1685* (2013.01); *A61H 2201/1692* (2013.01)

(58) Field of Classification Search
CPC .... A61H 2201/1215; A61H 2201/1669; Y10T 74/18024–18352
See application file for complete search history.

(56) References Cited

U.S. PATENT DOCUMENTS

| | | | | |
|---|---|---|---|---|
| 7,163,508 | B1 | 1/2007 | Washington | |
| 2005/0228219 | A1 | 10/2005 | Jewell | |
| 2008/0004577 | A1* | 1/2008 | Matsuura | A61B 10/0058 604/317 |
| 2009/0099413 | A1* | 4/2009 | Kobashikawa | A61H 19/34 600/38 |
| 2011/0271779 | A1* | 11/2011 | Corcoran | F16H 25/20 74/89.23 |
| 2014/0046127 | A1* | 2/2014 | Topolovac | A61H 19/44 600/38 |

FOREIGN PATENT DOCUMENTS

| | | | | |
|---|---|---|---|---|
| FR | 2942713 | A1 | 9/2010 | |
| JP | 2005312497 | A | 11/2005 | |
| WO | WO-03099189 | A1 * | 12/2003 | A61H 19/44 |

OTHER PUBLICATIONS

Search Report, issued by the German Patent Office in German application No. 10 2013 102 280.4, dated Mar. 7, 2013.
Report on Reexamination Decision, dated Dec. 26, 2018, in connection with Chinese Patent Application No. 201480012760.2.
Decision of Grant, dated Feb. 27, 2018, in connection with Russian Patent Application No. 2015142507.
Certificate of Grant of Patent, dated Jul. 24, 2017, in connection with Singapore Application No. 11201507139V.
Response to Reexamination Notification, dated Aug. 31, 2018, in connection with Chinese Patent Application No. 201480012760.2.
Office Action, dated Jul. 27, 2017, in connection with Columbian Application No. 15-203.871.

* cited by examiner

DEVICE FOR SEXUAL STIMULATION HAVING A HOLLOW PISTON

FIELD OF THE INVENTION

The invention pertains to a device for sexual stimulation.

STATE OF THE ART

Devices for sexual stimulation, which can carry out rotational movements or translational movements are known from the prior art. US 2005/022819 A1 discloses a unit for sexual stimulation having a back-and-forth movable "shuttle". In principle, the unit of US 2005/022819 A1 may be used for both female and male stimulation. However, the use in male stimulation leads to difficult handling. The reason being that the device must be re-configured for this purpose in such a way that it becomes extremely large and unwieldy.

Basically, there is a demand for handy units and devices for male stimulation. In general and herein, the term "male stimulation" is apprehended as a stimulation of the male member.

DISCLOSURE OF THE INVENTION

An object of the invention is to provide a device, in particular, a handy unit for male stimulation, which is improved with respect to the prior art.

The object is achieved with a device for sexual stimulation having a hollow piston, a drive cylinder, and transmission means for the transmission of a rotational movement of the drive cylinder into an axial movement of the hollow piston, wherein the drive cylinder encloses the hollow piston at least partially.

BRIEF DESCRIPTION OF THE FIGURES

Embodiments are described with reference to the figures, whereby the figures show.

DESCRIPTION OF EMBODIMENTS

Hereinafter, typical exemplary embodiments are described, whereby to some extend identical reference signs are used for identical or in part similar embodiments, to some extend also for several different embodiments. Basically, the application is not limited to the different embodiments but rather the scope is determined by the claims. To some extent, individual parts are merely exemplified in connection with one figure, however, if these parts are shown in other figures, they are not necessarily described a second time.

Figure 1:
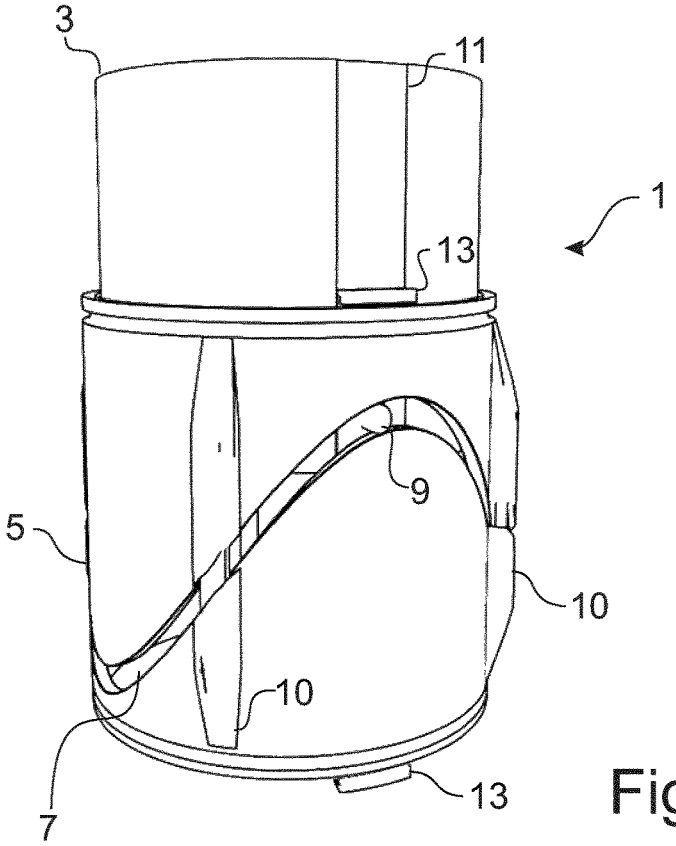
FIG. 1 shows a schematic view of an embodiment of the invention.

FIG. 1 shows a typical embodiment of a device 1. The device 1 of FIG. 1 comprises a hollow piston 3 and a drive cylinder 5. The drive cylinder 5 encloses the hollow piston 3 at least partially.

Thereby, enclosing typically means that the hollow piston has a smaller outer diameter than the inner diameter of the drive cylinder. Further, depending on the operational state, the hollow piston is typically at least partly or fully inserted in the drive cylinder.

The device 1 of FIG. 1 comprises transmission means for converting a rotational movement of the drive cylinder 5 to an axial movement of the hollow piston 3. For the purpose thereof, a guide 7 is provided in the drive cylinder 5. Acting as a guide element, a pin 9 that is firmly connected with the hollow piston engages with the guide. The guide 7 has a sinusoidal progression in circumferential direction. Upon rotation of the drive cylinder 5, a translational movement of the hollow piston 3 in the direction of its longitudinal axis, i.e. axially, is accomplished by entrainment of the pin 9 in the axial direction in the guide 7. The drive cylinder 5 of the embodiment of FIG. 1 can be driven manually by means of handles 10.

Further driving possibilities are described in connection with the other figures.

Typical embodiments of the device comprise a hollow piston and a drive cylinder, whereby transmission means are provided for converting the rotational movement of the drive cylinder in an axial movement of the hollow piston. Axial movements are to be apprehended as translational movements in direction of the longitudinal axis of the hollow piston. In typical embodiments, the transmission means are adapted to exclusively allow a translational and, in particular, to prevent a rotational movement of the hollow piston.

According to further embodiments, the hollow piston can also be set into a rotational movement by the transmission means. Typical transmission means comprise guiding elements like, for example, screws, wheels, bearings or pins, which may be guided in guides such as grooves, cranks or notches. Typically, in embodiments the pin is provided on an outer side of the hollow piston and the guide in the drive cylinder. According to further embodiments, the guiding element, for instance, the pin, the wheels or the bearing is provided on the inner side of the drive cylinder and the guide in the hollow piston. Further transmission means comprise gears, for instance, linear gears with a gear rack or spindle. The advantage of guided pins or screws is a simple construction; the advantage of gears is a high load-bearing capacity. The advantage of wheels or bearings is a low friction.

According to embodiments, a wheel or wheels, in particular, two wheels are provided as guiding element, which engage with a guide. In this way the friction may be reduced.

According to embodiments, the guide progresses wavelike in a circumferential direction along at least a portion of the circumference of the drive cylinder or the hollow piston. Thereby "wavelike" comprises a sinusoidal or a continuous curve with an ascending and descending portion, whereby typically a first derivative of the curve may also be continuous in order to allow uniform movements. Typical waveforms comprise one or more upward and downward periods or amplitudes.

Typically, the drive cylinder may be rotated in both directions relative to the hollow piston.

According to embodiments, the guide is provided as a notch or a slot. According to an embodiment as slot, the drive cylinder is separated into an upper and lower part. These parts can be, for example, connected via handles provided on the outside of the drive cylinder. According to an embodiment as notch on the inner side of the drive cylinder, the drive cylinder may be provided in one piece. Other possibilities include a division of the drive cylinder in longitudinal direction in order to facilitate the manufacture of the drive cylinder or the assembly.

Typically, the pin or the screw is spring mounted in order to enable a reliable guidance without, for example, the pin jumping out of the groove or notch. An unsprung mounting in contrast allows for a more simple set-up.

A slip joint 11 is provided in the hollow piston 3, in which a rail 13 is mounted for guiding the pin 9 in axial direction.

Figure 2:
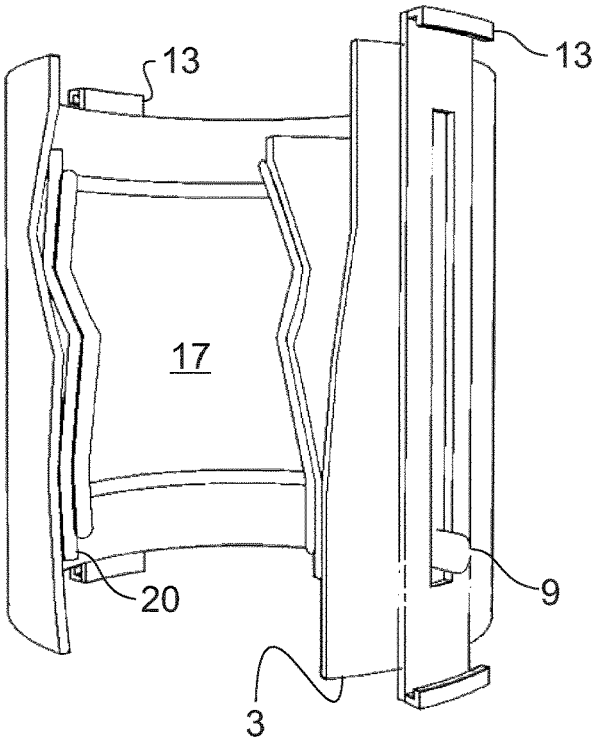
FIG. 2 shows schematically parts of the embodiment shown in FIG. 1 in a partially cut view.

FIG. 2 shows a partially sectioned view of parts of the embodiment of FIG. 1. In particular, FIG. 2 shows the guidance of the pin 9 in the axially aligned rail 13. In this way, the rotational degree of freedom of the hollow piston 3 is locked with respect to the rail 13. A rotation of the drive cylinder 5 results in an up- and downward movement in axial direction of the hollow piston 3. Thereby, the hollow piston 3 moves in the direction of its two openings. Since the rotational degree of freedom of the hollow piston 3 is locked, it cannot rotate together with the drive cylinder 5.

Typical embodiments comprise a linear guide for the hollow piston so that the rotational degree of freedom of the hollow piston is locked. The linear guide typically comprises a rail, a carrier system, a joint, a pin in a groove or a slip joint for a rail.

The hollow piston 3 in FIG. 2 comprises a padding 17 arranged on the inner side of the hollow piston 3.

The padding is provided in typical embodiments and optionally comprises a gel cushion, silicone or foam. According to further embodiments, in order to simplify the set-up, the inner side of the hollow piston is unpadded.

Figure 5:
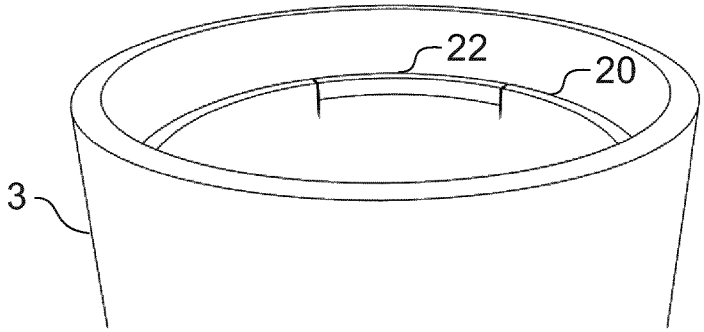
FIG. 5 shows a snap lock, which can be used in embodiments.

According to the embodiment shown in FIG. 2, the padding 17 is arranged on a ring insert 20. The ring insert 20 has a snap lock 22, which is shown in FIG. 5. The snap lock 22 allows an installation of the padding 17 or also cushions or further pipes. The snap lock can function similarly to a fastener of a lens cap. Further possibilities for attaching include Velcro fasteners or adhesive tabs with adhesion material. Embodiments lacking a snap lock are assembled more easily. A snap lock offers the possibility to insert additional extensions or padding within the hollow piston. Such insertion can take place recursively so that a plurality of sizes and lengths can be used.

The configuration of the inner surface of the ring inserts of typical embodiments may be smooth, corrugated or rough. Also threads or other surface characteristics may be provided.

In typical embodiments, a sleeve of flexible material is provided at the openings or at one of the openings of the hollow piston. Typical embodiments of such sleeves are waterproof or dustproof. Typical materials for such sleeves include silicone, rubber or flexible plastics. A further possibility is a tube-shaped inlet, which is guided through the hollow piston. In typical embodiments, the drive cylinder is connected via the sleeve with the hollow piston. The drive cylinder is typically mounted with bearings, sliding disks, Teflon, ceramic bearings, epoxides or sliding material.

Figure 3:
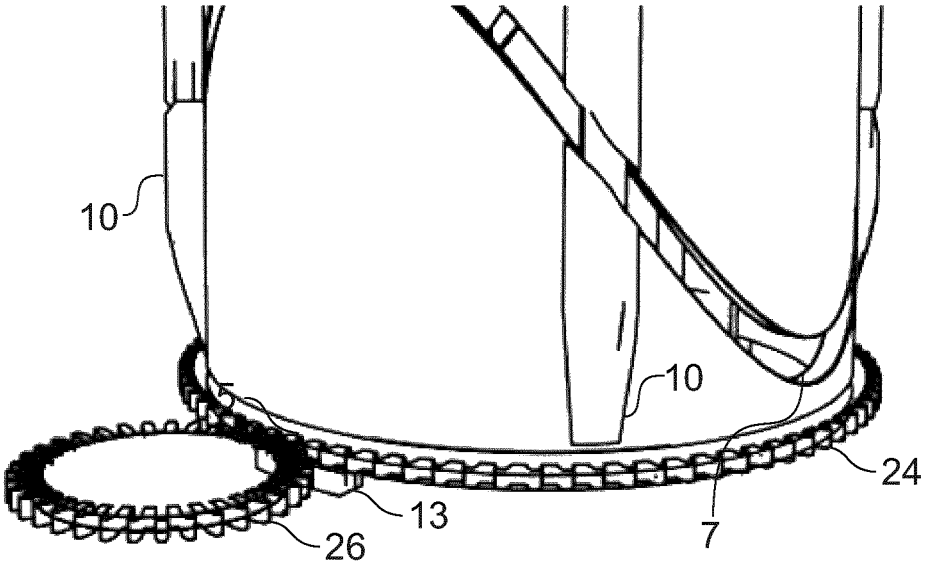
FIG. 3 shows one variation of a drive of the embodiments.

FIG. 3 schematically shows parts of a typical drive for a device 1 according to an embodiment. A drive cylinder 5 of the device 1 of FIG. 3 is equipped with a rotating ring gear 24 that is driven by a gear wheel 26. In typical embodiments, the gear wheel 26 is driven by an electro motor (not shown). By controlling the power of the electromotor with a control unit (not shown) the rotational speed of embodiments may be adjusted. Further drives comprise hydraulic motors, a combustion motor or a turbine, for example, a wind turbine. A further possibility for controlling the speed of movement is the incorporation of a reduction gearbox.

Figure 4:
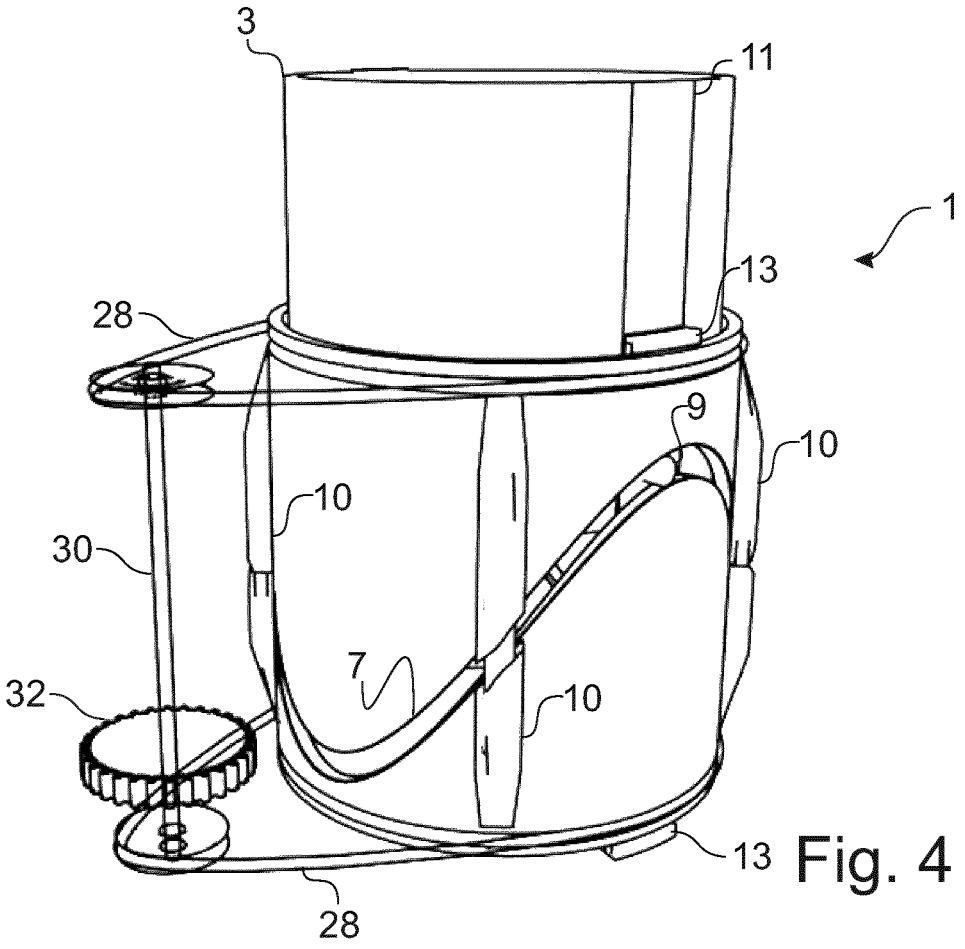
FIG. 4 shows a further variation of a drive of the embodiments.

FIG. 4 shows a further embodiment of a drive with drive belts 28 that are driven by a shaft 30 and that also enclose the drive cylinder 5 at least partly. The shaft 30 is put into motion via a gear wheel 32. The drive with the drive belts 28 provides the advantage that in the case of overload, the drive belts 28 on the drive cylinder 5 may slip through so that an overload of a drive does not occur.

Figure 6:
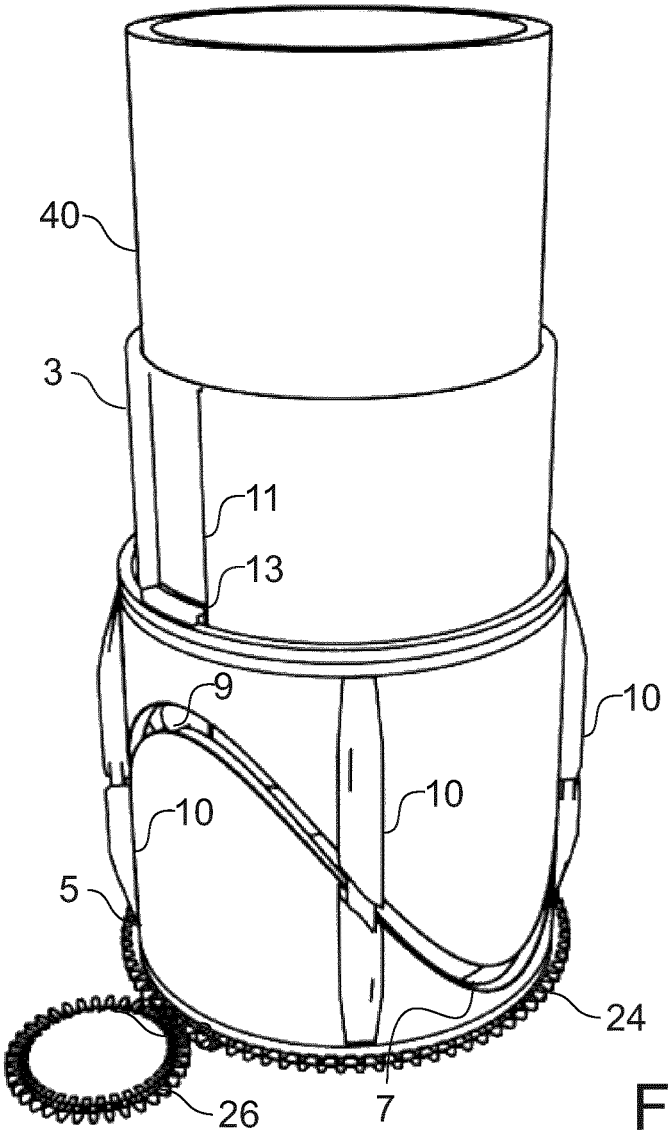
FIG. 6 shows a schematic view of a further embodiment.

FIG. 6 schematically shows a further optional embodiment of device 1 with a hollow extension body 40. The hollow extension body 40 is fitted into or onto the hollow piston 3 and allows an extension of the interior space of the device, for example, for an improved stimulation.

The invention claimed is:

1. A device for sexual stimulation of a male member comprising:

a hollow piston for accommodating a male member;

a drive cylinder; and transmission means for converting a rotational movement of the entire drive cylinder in a single direction into a reciprocating axial movement of the hollow piston, wherein the transmission means comprise a guide element and a guide, wherein the guide element engages with the guide, wherein the guide progresses wavelike as a series of smooth and sinusoidal curves, in a circumferential direction, along at least a portion of the circumference of at least one of the drive cylinder or the hollow piston, and wherein the drive cylinder encloses the hollow piston at least partially.

2. The device according to claim 1, wherein the guide element is provided on an outer side of the hollow piston and the guide is provided in the drive cylinder.

3. The device according to claim 1, wherein the guide is a notch or a slot.

4. The device according to claim 1, comprising a linear guide for the hollow piston configured to limit the rotational degree of freedom of the hollow piston.

5. The device according to claim 1, comprising a drive for driving the drive cylinder.

6. The device according to claim 1, comprising a hollow extension body for mounting onto the hollow piston.

7. The device according to claim 1, comprising a padding on an inner side of the hollow piston.

8. The device according to claim 1, wherein the guide element is arranged on an inner side of the drive cylinder and the guide is positioned within the hollow piston.

* * * * *